US005507322A

United States Patent [19]

Nasrallah

[11] Patent Number: 5,507,322

[45] Date of Patent: Apr. 16, 1996

[54] DEVICE AND METHOD FOR FORMING PLANAR DISK TRANSFORMER WINDINGS

[75] Inventor: Chaoukat Nasrallah, Cary, N.C.

[73] Assignee: ABB Power T&D Company Inc., Blue Bell, Pa.

[21] Appl. No.: 166,469

[22] Filed: Dec. 14, 1993

[51] Int. Cl.[6] ..... B21F 3/00

[52] U.S. Cl. ..... 140/92.1

[58] Field of Search ..... 140/92.1, 92.2

[56] References Cited

U.S. PATENT DOCUMENTS

| | | | |
|---|---|---|---|
| 2,140,137 | 12/1938 | Merkle | 140/92.2 |
| 2,930,539 | 3/1960 | Bremer | 140/92.2 |
| 3,750,719 | 8/1973 | Goldman et al. | 140/92.2 |
| 4,081,003 | 3/1978 | Checheljuk et al. | 140/92.2 |

*Primary Examiner*—Lowell A. Larson
*Attorney, Agent, or Firm*—Woodcock Washburn Kurtz Mackiewicz & Norris

[57] ABSTRACT

A device and process which automatically forms centripetal transformer windings wound from outside diameter to inside diameter. The device includes an adjustable diameter ring which surrounds a mandril and can be clamped to or released from the mandril. Motors located on the ring each include a spacer arm which engages the mandril and a second arm which contacts and positions a wire at an adjusted radius as it is being wound into a turn of a transformer winding. The ring is vertically movable and the position of the second arm with respect to the mandril is also adjustable in order to form the turns of the transformer winding.

8 Claims, 4 Drawing Sheets

DEVICE AND METHOD FOR FORMING PLANAR DISK TRANSFORMER WINDINGS

BACKGROUND OF THE INVENTION

1. Field of the Invention

This invention relates to electrical transformer devices, and more particularly relates to a novel apparatus and the process for winding a centripetal winding or disk for a transformer.

2. Description of the Related Art

Processes for winding the coils of high voltage transformers are well known. Such coils are wound on a mandril as a succession of flat coils, the first wound centrifugally (wound from inside diameter to outside diameter), and the second wound centripetally (from outside diameter to inside diameter) and so on, until all turns are completed. They may be wound on either a vertical or horizontal winding machine.

When using a vertical winding machine (with the axis of the coil vertical), the process for winding a centripetal coil requires the use of radial step blocks which support the wire (square or round in cross-section) to the desired spiral pattern, with the coil wound on the step blocks to a helical form, which is later flattened. This process requires step blocks of different shapes, depending on the number of turns to be wound, their diameters and their turn-to-turn spacing. The process is also tedious and labor-intensive.

When forming a centripetal winding in a horizontal disk winding machine, with the coil axis horizontal, the wire is wound "randomly" for the required number of turns, and is then stacked accurately, by hand, against the spacer for the previous disk. Thus, this process is also labor-intensive and tedious.

SUMMARY OF THE INVENTION

The present invention provides a novel automatic planar disk winding system which can automatically wind planar centripetal transformer disk windings without the use of step blocks or hand stacking.

In accordance with the invention, an adjustable diameter ring surrounds the mandril and may be axially moved along the mandril after the formation of a full disk or winding. A plurality of radial step controlled arms are fixed to the ring and project into and engage the surfaces of respective pockets in the mandril. Suspended arms are movable along the lengths of the step controlled arms to define a precise winding location for the coil being wound around these arms. The locations of the arms are computer controlled, and are repositioned to receive the next turn of the winding at a decreased radius, depending on the desired shape of the winding.

The system is fully automated by an appropriate programmable logic controller. The automatic process needs no attention from the operator. The winding process is continuous for the outside to inside disk. The suspendable arms of the step controlled arms keep tension on the outer turns while additional inner turns are being wound. The controlling mechanism of the suspendable arms is to maintain tension on the outer turns until the next turn is begun. Then the first step controlled arm, at the start of the turn, moves backward, followed by each arm in succession. Reverse movement is performed by the suspendable arms depending on the width of the winding cable. The sequence of the step controlled arm operation is controlled by inputs from position sensing devices.

After the winding process is completed for that disk, the assembly is lifted up automatically. Then the suspendable arms return to their calibrated positions while the winding process from inside to outside is being performed. The system then moves down to the next position for performing another centripetal disk winding operation.

DETAILED DESCRIPTION OF THE PREFERRED EMBODIMENTS

Figure 1:
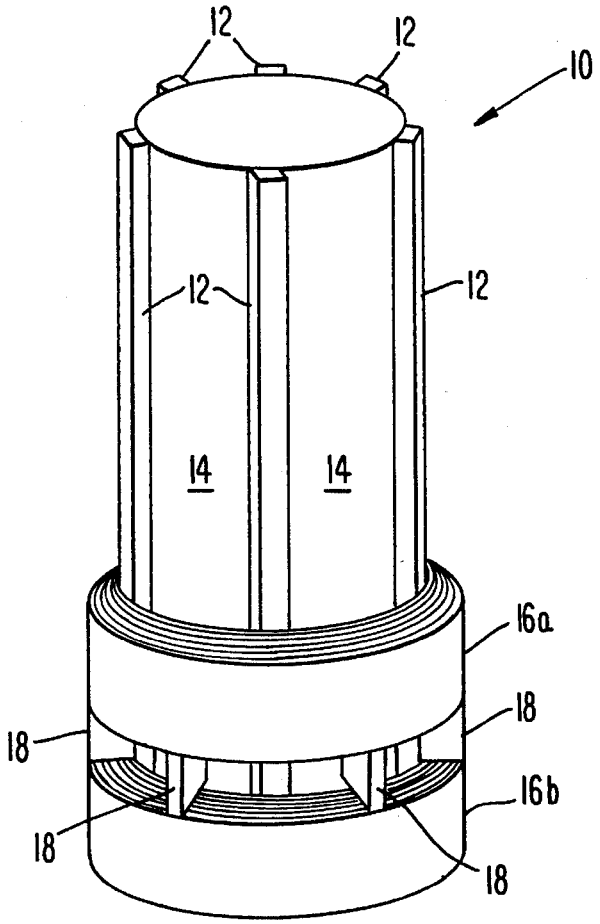
PRIOR ART Fig. 1
FIG. 1 is a perspective view of a conventional mandril for receiving transformer windings or disks.
Figure 2:
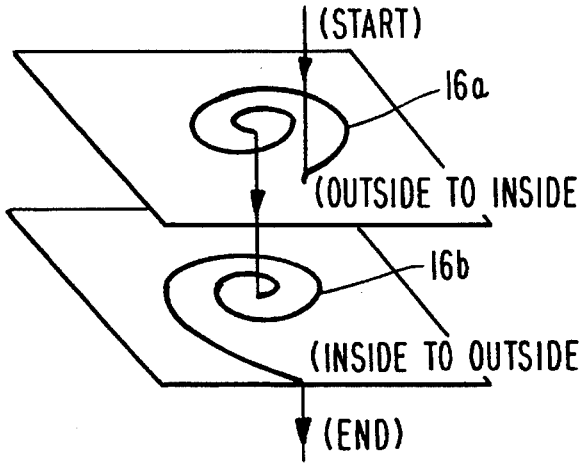
FIG. 2 is a schematic illustration of two continuous transformer windings on the mandril of FIG. 1, the top winding being formed centripetally and the bottom winding being formed centrifugally as is known in the prior art.

Referring first to FIG. 1, there is shown a conventional transformer winding mandril 10 which includes numerous spaced insulation strips 12 which form pockets 14 located between adjoining pairs of strips 12. Transformer disks or windings (two of which, **16*a* and 16*b*, are shown in FIG. 1) are wound on mandril 10 and are separated by insulation spacers 18. The windings 16*a* and 16*b* are wound in a continuous manner on mandril 10, one transformer winding 16*a* being wound centripetally (from outside to inside) while the adjacent transformer winding 16*b* is wound centrifugally (from inside to outside) as schematically shown in FIG. 2. The conductors forming the windings 16*a* and 16*b* are of copper or aluminum and may be in thin sheet form or may be of square or round cross-section. During the winding process, mandril 10** may be oriented either vertically or horizontally.

Figure 4:
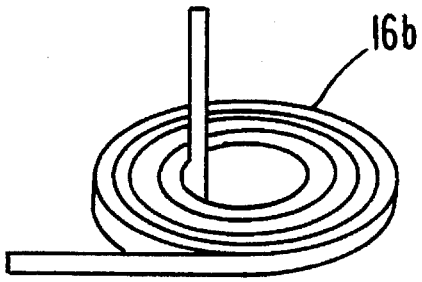
FIG. 4 is a perspective view of the same winding shown in FIG. 3, after having been forced into a disk shape.
Figure 5:
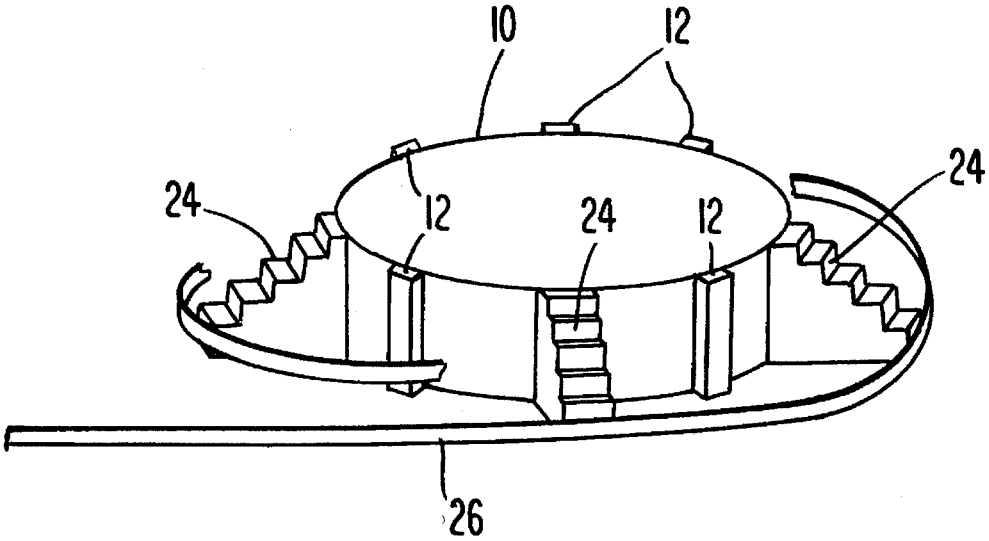
PRIOR ART Fig. 5
FIG. 5 is a perspective view of a known technique using step-shaped blocks for forming the centripetal transformer winding of FIGS. 3 and 4.

The centrifugal winding **16*b* is easily wound in the normal manner, from inside to outside. However, it is more difficult to wind centripetal winding 16*a*. The usual method for manufacturing centripetal transformer windings uses step-shaped blocks as shown in FIG. 5. Numerous step-shaped blocks 24 are placed in contact with mandril 10 within pockets 14 of FIG. 1 as shown in FIG. 5. Thus, one block 24 is placed within each pocket 14. Blocks 24 are dimensioned to obtain the correct diameter for each turn of the winding 16*b*. The winding formed, as guided by blocks 24, will have the conical shape shown in FIG. 3, which is later pressed to the flat pancake shape of FIG. 4**.

The number of steps and the dimension of each step on blocks 24 varies for each coil design because the wire size and number of turns varies with each particular design.

Figure 3:
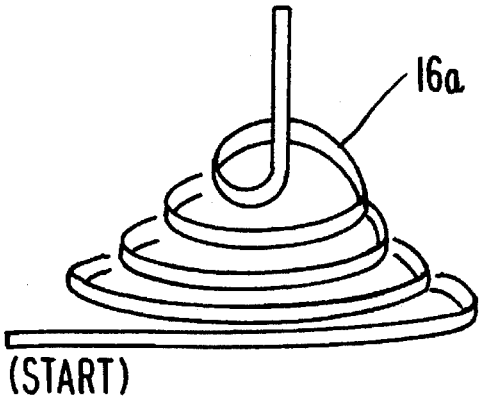
FIG. 3 is a perspective view of a prior art conical, spiral-shaped centripetal transformer winding of the prior art.

In order to form the conical transformer winding 16*b* in FIG. 3, a transformer wire 26 (FIG. 5) is wound on the lowest step of block 24. As the transformer wire 26 is next wound on block 24, each turn contacts the next higher step of block 24. After all turns are completed, a rectangular block (not shown) is inserted underneath transformer wire 26 to raise it to the level of the inner turns. After the coil 16*b* is completed, blocks 24 are removed, and the rectangular leveling blocks are removed and the completed coil is laid on top of the insulation spacer 18 atop the last and adjacent (centrifugal) disk 16*a*.

The conventional methods of manufacturing centripetal transformer windings are time-consuming and are inefficient processes requiring considerable manual effort. Multiple tasks are required to perform a single function, and an operator has to repeat tedious functions.

Figure 6:
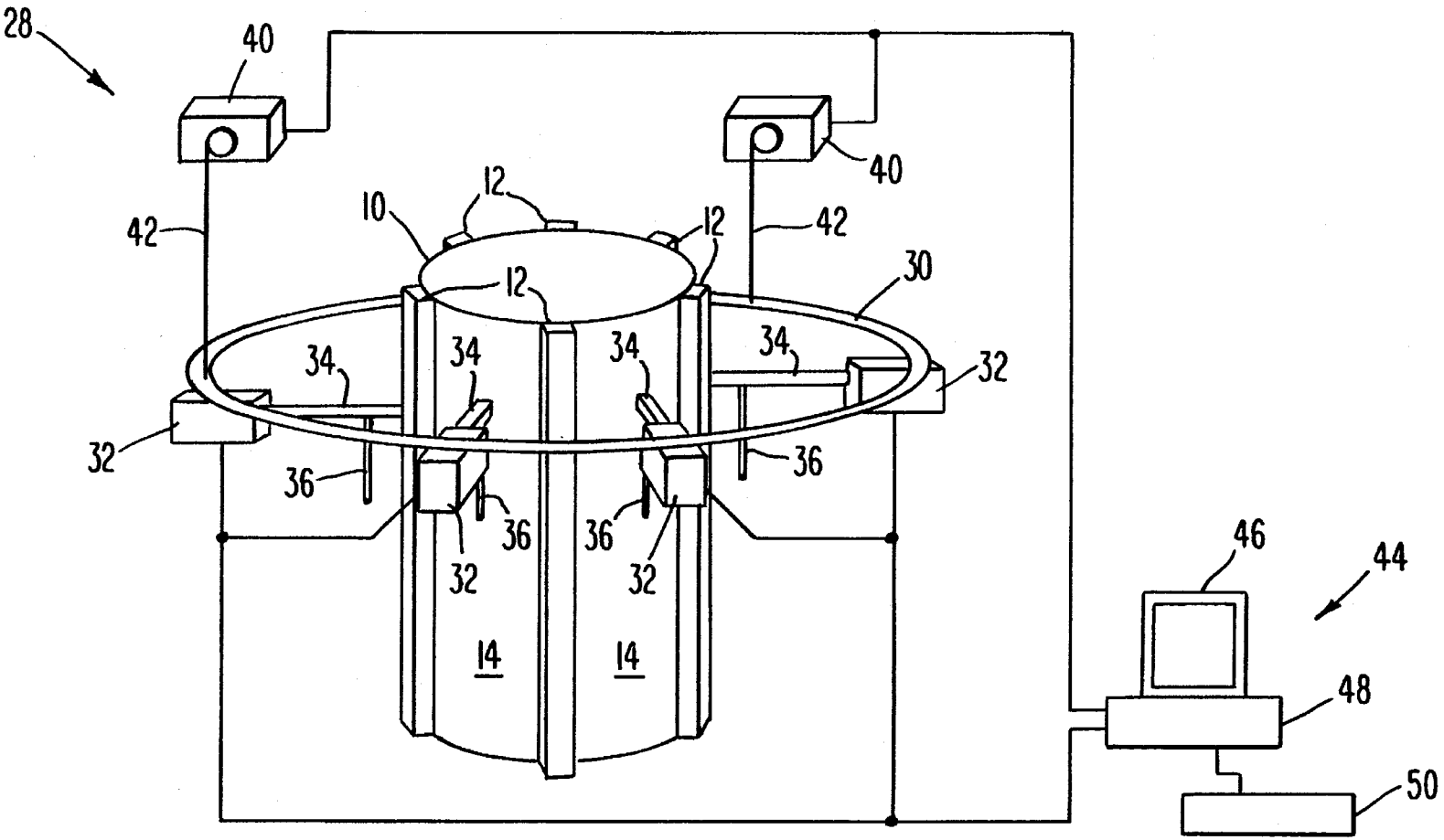
FIG. 6 is a perspective view of the apparatus of the present invention for automatically forming transformer windings.
Figure 7:
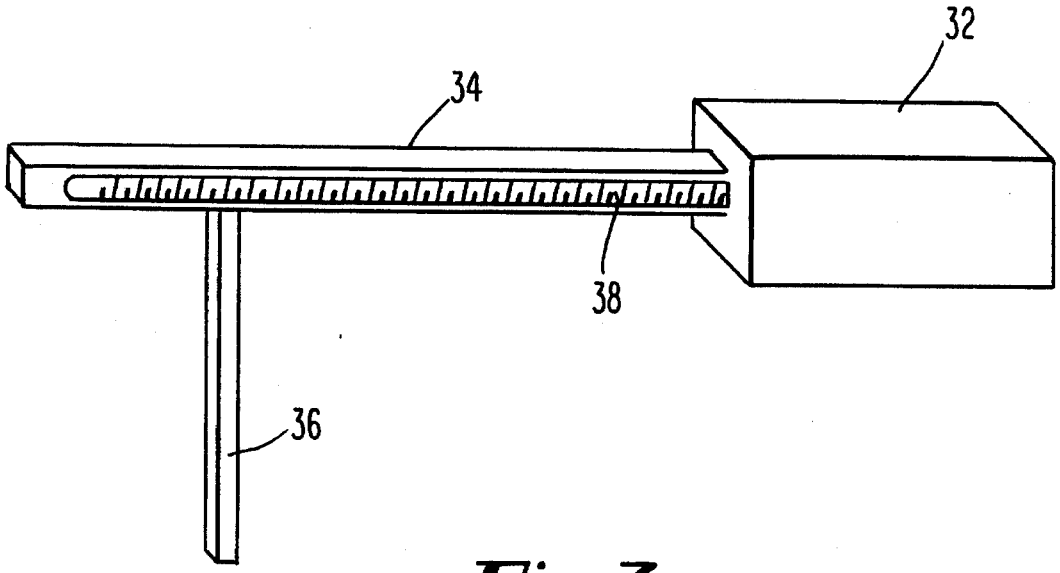
FIG. 7 is a perspective view of a controller arm portion of the device shown in FIG. 6.

The present invention, both process and apparatus, is best shown in FIGS. 6 and 7.

Figure 8:
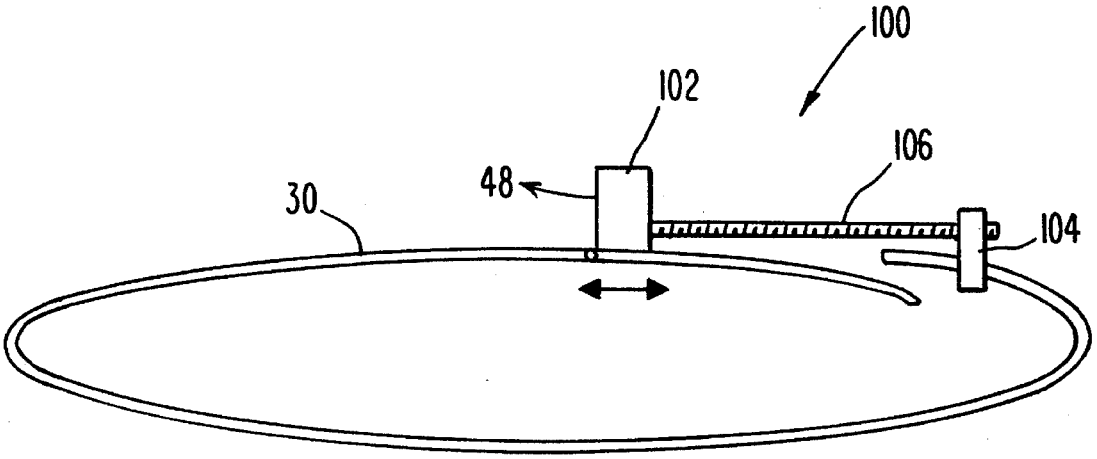
FIG. 8 is a perspective view illustrating an adjusting means for the adjustable split ring portion of the device shown in FIG. 6.

The novel assembly or system 28 of FIG. 6 includes an adjustable diameter ring 30 which surrounds mandril 10 when it is in operation. The diameter of ring 30 is adjustable in any suitable manner. For example, it may be split, and the ring can be drawn open or more closed at the split by a motor driving system. As shown in FIG. 8, a motor driving system is shown generally at 100 and comprises motor 102 mounted on one side of the split adjustable diameter ring 30 and an internally threaded fix holder 104 mounted on the opposite side of the split ring 30. Also, shown in FIG. 8, as part of motor driving system, is a threaded rod 106 connected at a first end 108 thereof to the motor 102 and at the opposite end thereof to the fix holder 104. It will be understood to those skilled in the art that the motor 102, when energized by the control means (shown in FIG. 1 and described below), is operable to turn the threaded rod 106 in a first direction, e.g., clockwise, to increase the diameter of the adjustable ring 30 and to turn the threaded rod in a second direction, e.g., counterclockwise, to decrease the diameter of the adjustable ring 30.

Attached to adjustable diameter ring 30 are numerous wire diameter adjustment assemblies, each including respective motors 32. Four motors are shown in FIG. 6, but it will be appreciated that any number of motors may be utilized in the invention, preferably one for each pocket 14. Motors 32 are preferably attached to the bottom of adjustable diameter ring 30, and each motor 32 includes a spacer arm 34 (see FIG. 7) extending out of the motor 32. The spacer arm 34 is adjustable and can be moved toward and away from the surface of mandril or pocket 14, at its free end. In a preferred embodiment, the diameter of ring 30 is adjustable to thereby move the ends of the rods 34 into and out of the clamping engagement with the surface of mandril 10.

Spacer arm 34 contains an adjustably positionable arm 36 which may use a threaded rod 38 extending out of motor 32 and rotated by motor 32 in order to adjust the position of arm 36 which extends downward from spacer arm 34 inward or outward of the center of the winding. Arm 36 acts as an inner stop for contacting and holding a transformer wire as it is wound past arm 36, as will be discussed in detail below.

Ring lifting and lowering motors 40 are provided above the adjustable diameter ring 30. Two motors 40 are shown in FIG. 6, although it will be appreciated that any suitable number of motors may be utilized in the invention. Each motor 40 includes a chain 42 which is connected at one end to the motor 40 and at another end located away from motor 40 to adjustable diameter ring 30. Motors 40 and chains 42 raise and lower ring 30. Thus, after a turn is formed, and, again, after a centripetal winding is completed, arms 34 are released from mandril or pocket 14 and the ring is raised to a new turn position, or so that a centrifugal winding can be next conventionally wound on mandril 10. The ring 30 is then lowered and arms 34 again engage mandril 14 to form the next planar centripetal winding.

The vertical position and diameter of ring 30, the position of spacer arms 34 and the position of arms 36 are both controlled by computer 44, which includes a monitor 46, a central processing unit (CPU) 48 and a device for inputting data 50, such as a keyboard. Numerous sets of pre-determined values corresponding to the dimension of each turn of a transformer winding are stored in computer 44, more specifically, in a memory portion of CPU 48 of computer 44. This data may be entered using keyboard 50 and monitor 46 by an operator. It may be modified as necessary and supplemented.

In operation, one set of values for the dimensions of a particular transformer winding to be manufactured is retrieved from CPU 48. An initial setting of the height and diameter of ring 30 is transmitted by computer 44 to assembly or system 28. The height of ring 30 is then adjusted by motors 40 using chains 42 and the diameter of ring 30 (and thus the position of the ends of arms 34) is adjusted and motors 32 are operated to, in turn, move threaded rod 38 and adjust the length of arm 34. Transformer wire is then fed to assembly or system 28 using any conventional feeding apparatus (not shown). Transformer wire is then wound relative to mandril 10 and around the wire contracting and holding arms 36 to form a first turn of the centripetal winding, with the rods 36 stepping inwardly to position successive inner turns of smaller diameter at their particular circumferential location. Computer 44 then controls motors 40 to expand and raise ring 30 to a given position and computer 44 also adjusts the position of threaded rod 38, moving them inwardly to release from the centripetal coil. The end of spacer arm 34 contacting mandril 10 then slides without friction along mandril 10 in pocket 14. Arms 36 are then moved inward toward mandril 10 at a position corresponding to the location of the next turn of the transformer winding and wire is next wound on repositioned arms 36 to form a second turn. This procedure is repeated until the desired number of turns are formed.

Although the present invention has been described in connection with the preferred embodiment thereof, many other variations and modifications will now become apparent to those skilled in the art without departing from the scope of the invention. It is preferred, therefore, that the present invention be limited not by the specific disclosure herein, but only by the appended claims.

What is claimed is:

1. A device for automatically winding a wire to form a centripetal transformer winding, comprising:

a mandril;

an adjustable diameter ring surrounding the mandril, the ring having a plurality of spacer arms connected thereto, each spacer arm comprising: means for contacting and holding the wire as it is wound into a turn of the transformer winding, the wire contacting the holding means and the holding means having a radial position with respect to the mandril which reduces the centripetal transformer winding diameter as the wire is wound;

means connected to the adjustable diameter ring for lifting the ring after the formation of the centripetal transformer winding;

means connected to the adjustable diameter ring for adjusting the diameter thereof; and means for controlling the adjusting means and the lift means for initially setting the diameter and vertical height of the ring to form a first transformer winding and subsequently adjusting the diameter of the ring and lifting the lift means to form additional turns of the transformer winding.

2. The device of claim 1, wherein the adjusting means comprises a motor and a threaded rod, the threaded rod being connected at a first end to the motor, the motor being operable by the control means to turn the threaded rod in a first direction to increase the diameter of the adjustable ring and to turn the threaded rod in a second direction to decrease the diameter of the adjustable ring.

3. The device of claim 1, wherein the wire contacting and holding means comprises an arm fixed to each spacer arm.

4. The device of claim 1, wherein the lift means comprises a plurality of mechanical lift systems, each lift system comprising a motor and a chain connected at a first end to the motor and at a second end to the adjustable diameter ring, the motor being operable by the control means to raise or lower the chain to adjust the vertical position of the ring.

5. The device of claim 1, wherein the control means comprises computer means connected to the adjusting means and to the lift means, the computer means including memory means for storing a plurality of sets of predetermined values corresponding to the dimensions of a plurality of transformer windings.

6. The device of claim 1, wherein the mandril is substantially centrally located within the adjustable diameter ring and the spacer arms radiate outwardly from the mandril to the adjustable diameter ring.

7. The device of claim 1 wherein a longitudinal axis of the wire contacting and holdings means is oriented substantially parallel to a longitudinal axis of the mandril.

8. The device of claim 1, wherein the lift means is positioned above the ring and the adjusting means is connected to a bottom portion of the ring.

* * * * *